US005505442A

United States Patent [19]

Chang et al.

[11] Patent Number: 5,505,442

[45] Date of Patent: Apr. 9, 1996

[54] ELECTRONICALLY DISTRIBUTING AND CONFIDENTIAL PAPER RECEIVER

[76] Inventors: Joseph Chang; Jenner Chang; Shih-Chin Chang, all of No. 26, Industry East 9th Rd., Science-Based Industrial Park, Hsin-chu, Taiwan

[21] Appl. No.: 249,887

[22] Filed: May 26, 1994

[51] Int. Cl.[6] ..... B65H 39/10

[52] U.S. Cl. ..... 271/298; 271/305

[58] Field of Search ..... 271/298, 297, 271/279, 287, 288, 305

[56] References Cited

U.S. PATENT DOCUMENTS

| | | | |
|---|---|---|---|
| 4,437,660 | 3/1984 | Tompkins et al. | 271/298 X |
| 4,501,419 | 2/1985 | Takahashi et al. | 271/288 |
| 4,973,041 | 11/1990 | Yamasaki | 271/298 X |
| 5,358,238 | 10/1994 | Mandel et al. | 271/298 |

FOREIGN PATENT DOCUMENTS

| | | | |
|---|---|---|---|
| 0241273 | 10/1987 | European Pat. Off. | 271/298 |

*Primary Examiner*—David H. Bollinger

[57] ABSTRACT

An electronic apparatus is disclosed for receiving and distributing confidential papers. This apparatus comprises: (a) a motor, which is connected to a plurality of gears, a plurality of transmission belts, and a plurality of correlated rollers, for transferring printed papers from a printer output to one of a plurality of closed-type paper bins via an arched paper guiding plate; (b) means for providing a computer signal to control the selection of the closed-type paper bin for sending the printed papers; (c) a main lock control system provided for locking and unlocking the closed-type paper bins in their entirety; (d) a plurality of independent lock control modules, each of the independent lock control modules being provided for everyone of the closable paper bins; (e) lock opening means provided with the independent lock control modules which allows a user to lock and unlock one of the closed-type paper bins by entering a set of computer-set codes.

6 Claims, 11 Drawing Sheets

ELECTRONICALLY DISTRIBUTING AND CONFIDENTIAL PAPER RECEIVER

FIELD OF THE INVENTION

This invention relates to an apparatus connected to a laser printer for electronically receiving and distributing confidential papers.

BACKGROUND OF THE INVENTION

Because of their high printing speed and the advantageous neatness and clearness of the printed fonts and graphics, laser printers have become some of the most useful machines in modern, offices. However, in order to save office space and avoid incurring the cost of having to purchase multiplicity of printer machines, generally an operating laser printer is connected to and shared by several computers. The printed documents are output from the public laser printer and are accessible to the public at large in paper receiving bins. There is no provision to provide confidential protection for the printed documents. This setup is therefore not convenient nor pertinent to those documents which contain confidential information or secret characteristics.

SUMMARY OF THE INVENTION

This invention relates to an apparatus for electronically receiving and distributing confidential papers. The apparatus disclosed in the present invention includes a set of closed type paper bins which are connected to a laser printer. The printed documents from the laser printer are delivered to these paper bins. The apparatus disclosed in the present invention utilizes a transmitting mechanism, which comprises a motor and a set of gears to drive a transmission belt equipped with a plurality of roller components, for receiving printed papers from laser printers, and delivering the printed documents into the specified paper bin or bins. A paper guiding plate located in the rear portion of the bins can be released by electronic signals from computers which also hinders the undesired papers to be transmitted. The computer signal also directs the papers to a correlated bin, and each bin is also provided with an independent lock control module, which can be unlocked by entering a set of computer-set codes.

The principal object of the present invention is to keep the content of the printed documents which are contained in closed paper bins from being detected by others, and hence increasing its confidentiality. In addition, the printed sheets are distributed to specified bins so that documents can be easily and conveniently retrieved.

Another object of the present invention is to install a lock system to each paper collecting bin for additional improvement of confidentiality. Thus, only the individual who owns the bin or other authorized persons can open the bins.

DETAIL DESCRIPTION OF PREFERRED EMBODIMENTS OF THE PRESENT INVENTION

Figure 1:
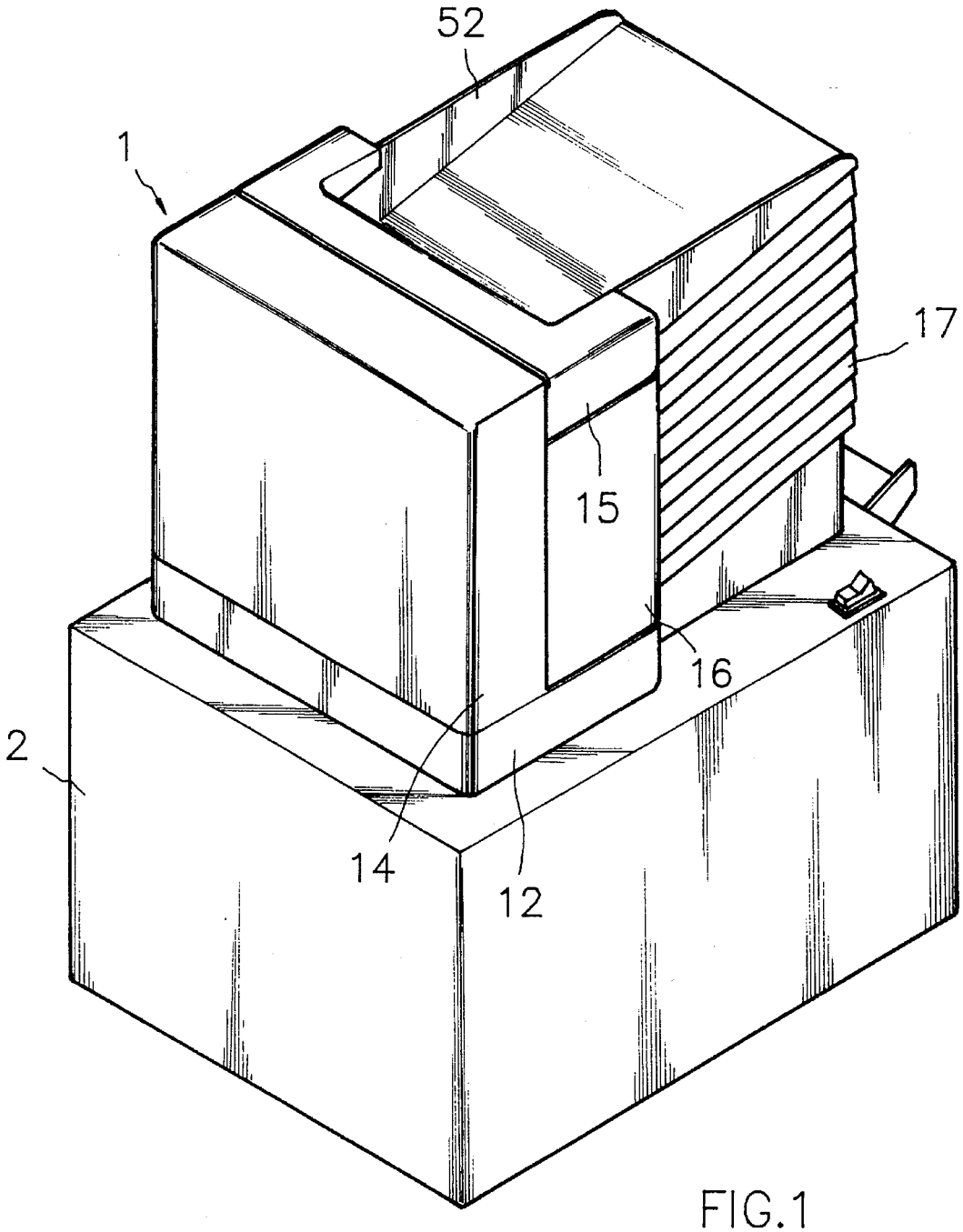
FIG. 1 is a perspective view of a preferred embodiment of the present invention.
Figure 2:
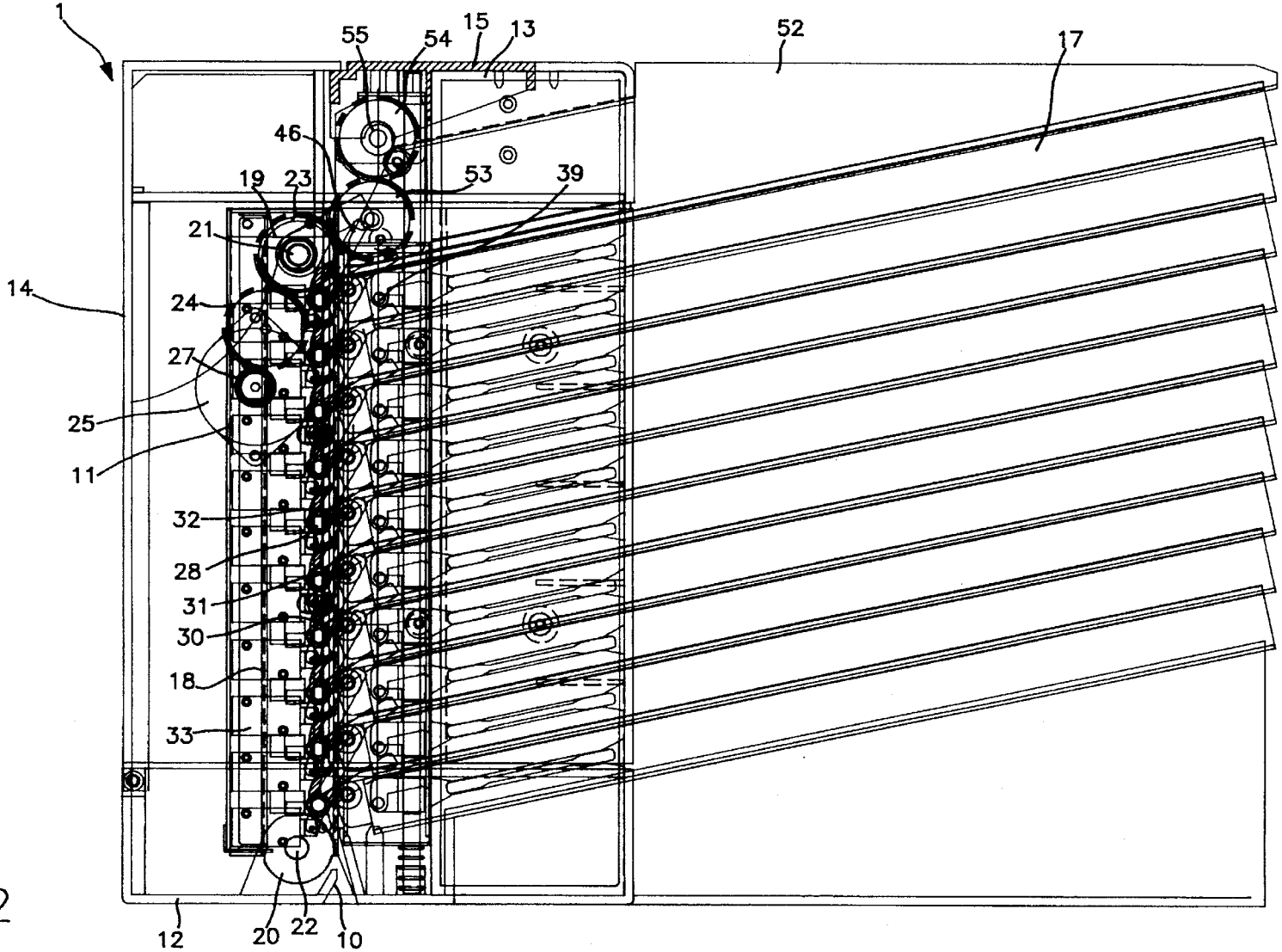
FIG. 2 is a left side view of the configuration of the delivering paper bin of the present invention.
Figure 3:
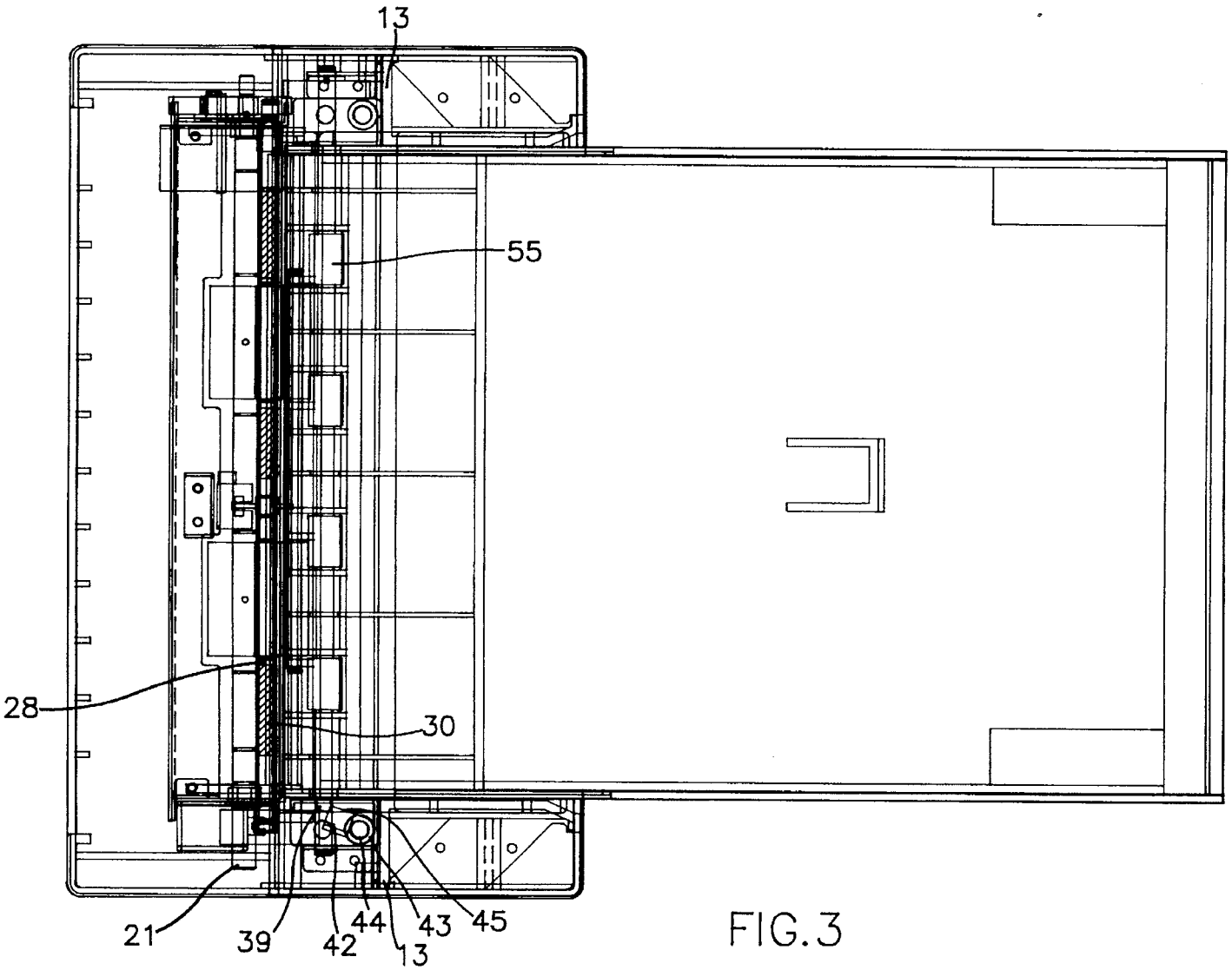
FIG. 3 is a top view of the delivering paper bin construction of the present invention.
Figure 4:
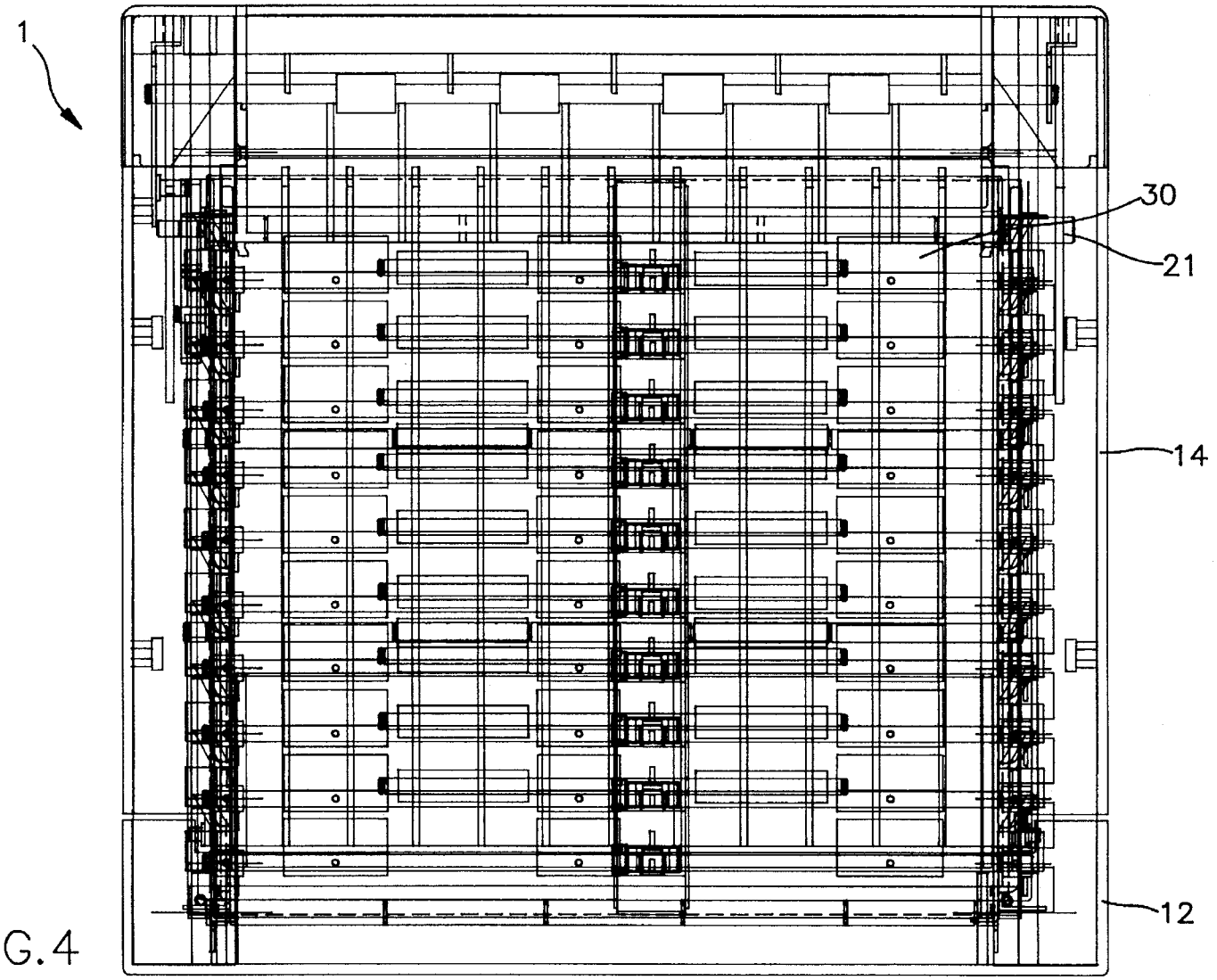
FIG. 4 is a rear view of the delivering paper bin construction of the present invention.
Figure 5:
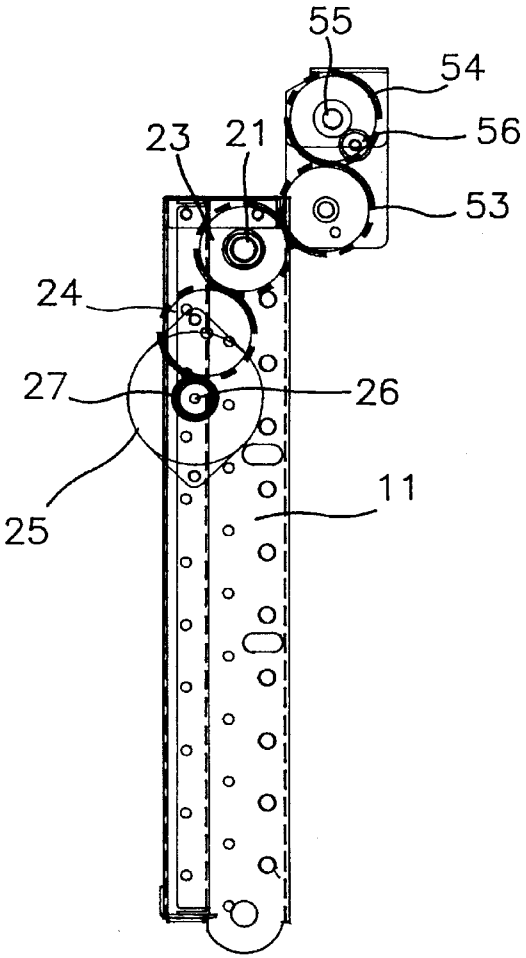
FIG. 5 is a side view of the transmission mechanical portion of the present invention.
Figure 6:
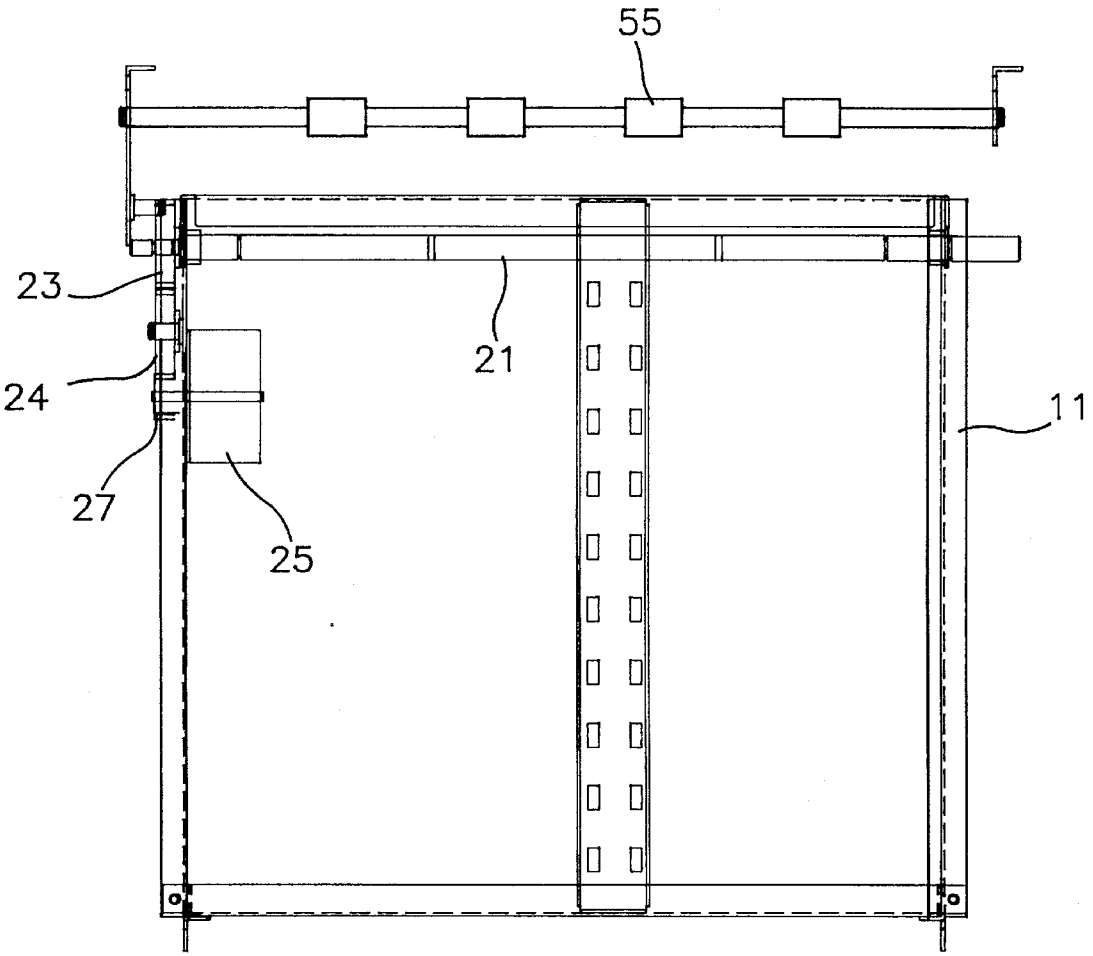
FIG. 6 is a rear view of the transmission mechanical portion of the present invention.
Figure 7:
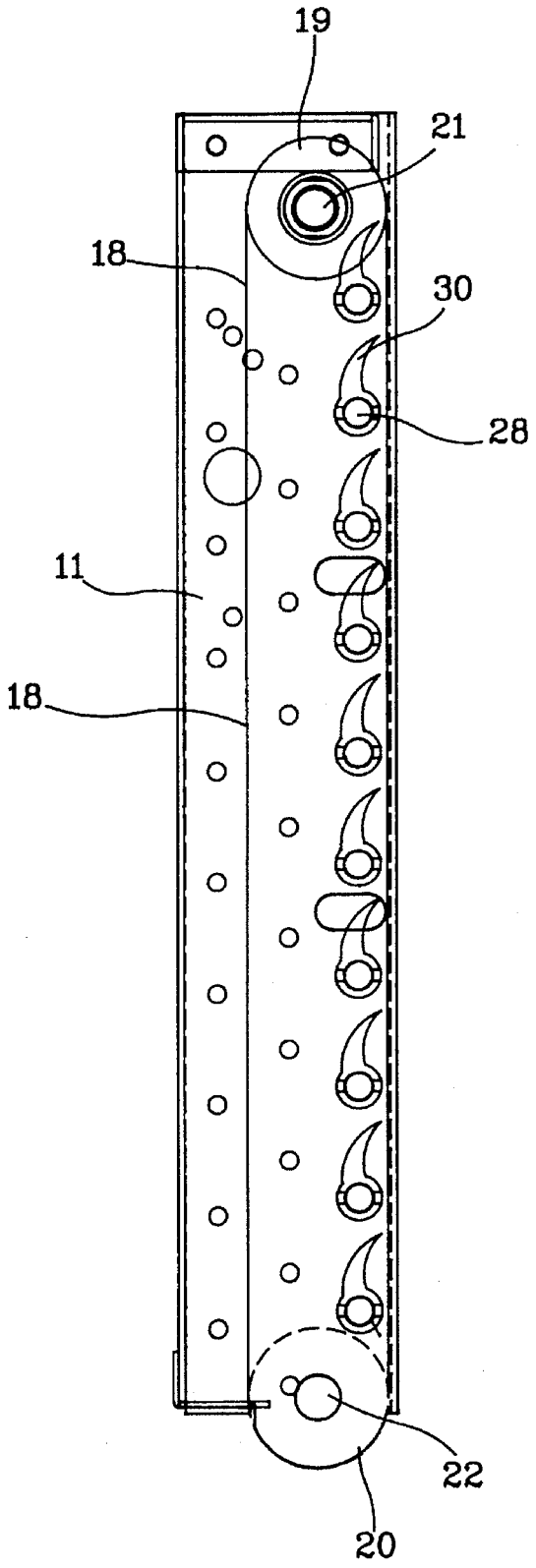
FIG. 7 is a side view of the portion of the paper guiding plate of the present invention.
Figure 8:
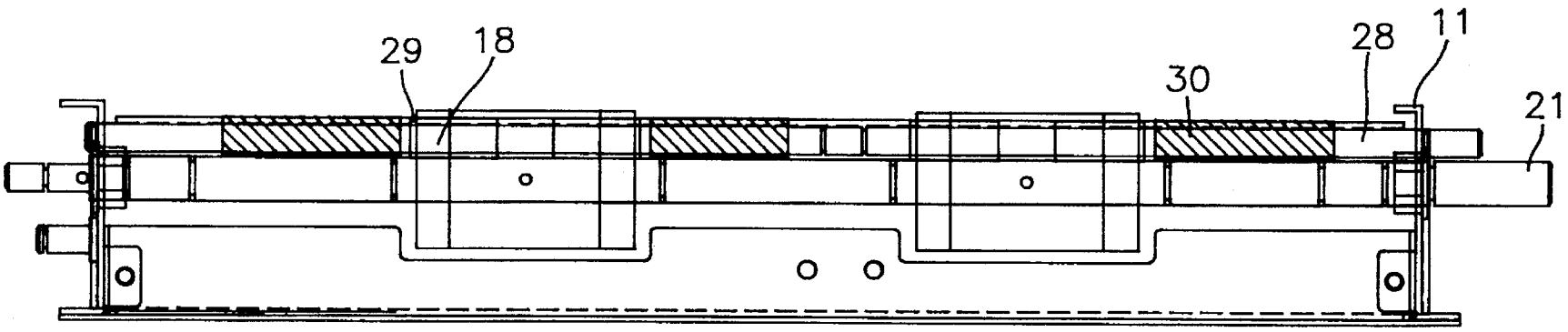
FIG. 8 is a top view of the portion of the paper guiding plate of the present invention.
Figure 9:
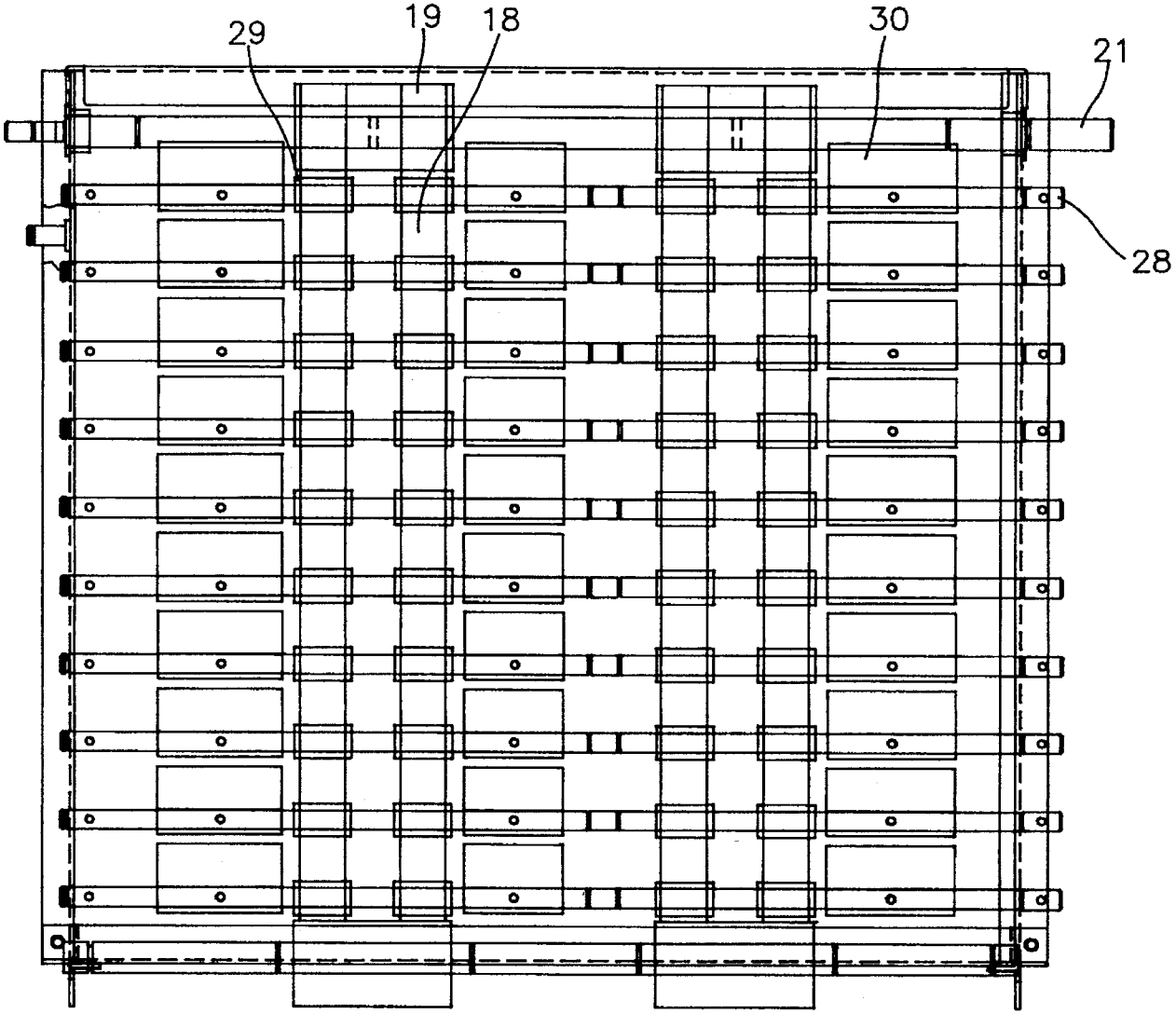
FIG. 9 is a rear view of the portion of the paper guiding plate of the present invention.

Referring to FIG. 1, the confidential paper receiver disclosed in the present invention 1 is located on the top of a laser printer 2 or any other business machines. This is an actual example of using the apparatus disclosed in the present invention. The printed papers dispatched from the laser printer 2 are collected in an elongated receiving slot 10 (referring to FIGS. 2 to 4). The rear portion of the present invention comprises a mobile rack 11 and its bottom end is set on the side base 12. A standing rack 12 is provided in front of the mobile rack 11. A rear cover 14, top lid 15, and side covers 16 are provided on the exterior of the mobile rack 11 and the standing rack 13. A plurality of paper bins 17 lie on top of base 12 and in front of the standing rack 13. The paper feeding belt 18 is located on the top of the receiving slot 10, which is on the bottom of base 12 (as shown in FIG. 7 to 9). The belt 18 is connected between the top and bottom belt wheels 19, 20, respectively. The belt wheels 19, 20 are connected to passive (i.e., driven) shaft 22, respectively, and these two shafts are mounted on the top and bottom portions, respectively of the mobile rack 11. A gear 23 is set on the left end of the drive shaft 21 (as shown in FIG. 5 and 6). The gear 23 matches with an idle gear 24. The idle gear 24 is further connected to another gear 27, which is fixed on an axis 26 of a motor 25. Via the rotation of the driving motor 25, gear 27, idle gear 24, and gear 23, these constitute a transmission mechanical structure, which drives both belt wheels 19 and 20, which in turn drive the belt 18 to support the left and right sides of the mobile rack 11 and stand against the front wedging paper rollers 29. Each paper guiding plate 30 is installed on an aforementioned shaft 28. Two sets of rollers 31 are located behind each paper bin 17, which is supported by a shaft 32. By the friction force of the belt 18 and the pressing of the roller 31 in the paper bins 17, the entering papers from the receiving slot 10 are transported upward. The paper guiding plates 30 of an arc shape and are provided on shafts 28 with supporting rollers 29.

The paper guiding plates 30 are constrained and reclined by a solenoid valve 33 located on the left exterior of the mobile rack 11, therefore, the papers are stemmed upward while moving and will follow the arched paper guiding plates 30 to be deposited into a specified paper bin 17. A plurality of paper bins 17 are provided in front of the standing rack 13. The number of paper bins is selected according to the number of the aforementioned paper guiding plates. The paper bins are stacked together and each having a flat and rectangular box shape. An opening is on the top end of the bin, allowing the papers to be easily delivered.

Figure 10:
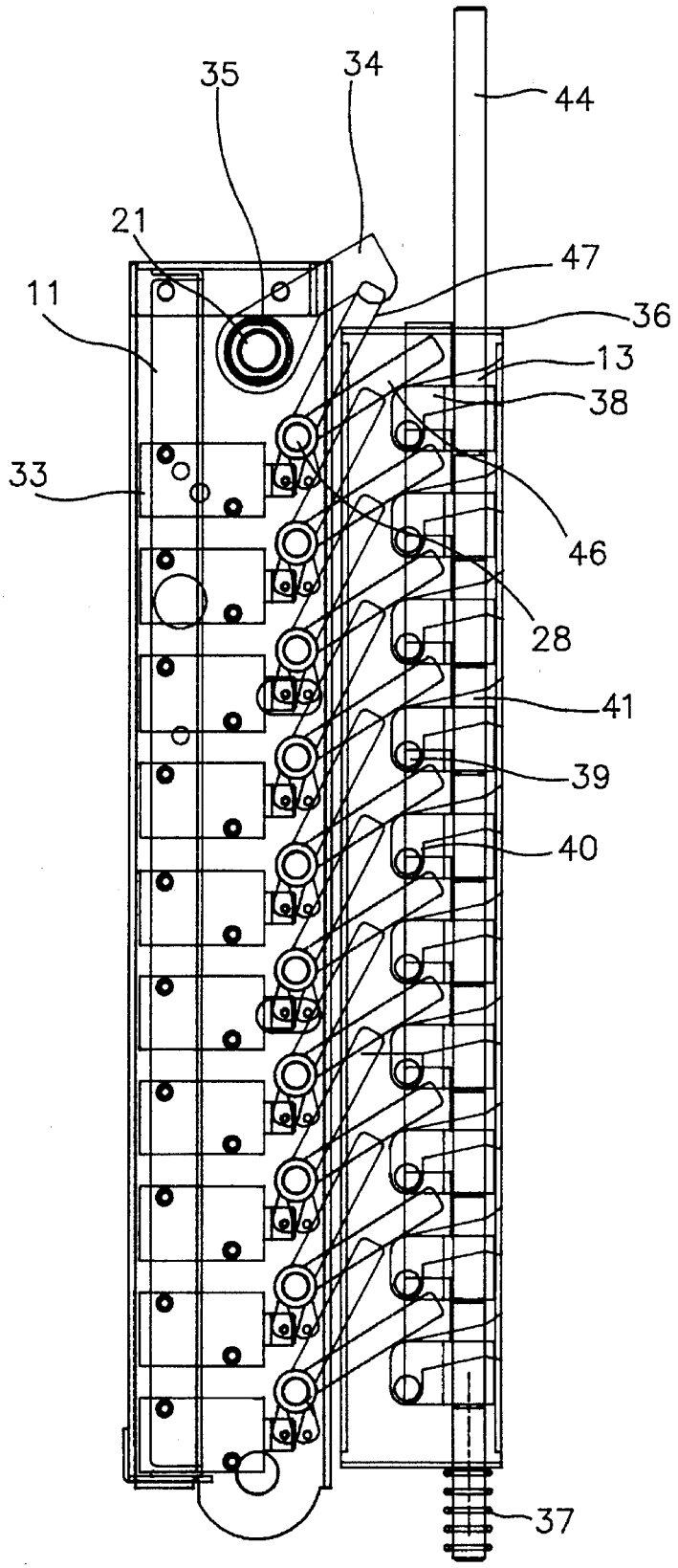
FIG. 10 is a side view of the portion of the main lock metal plate of the present invention.

A push rod 34 is fixed on the right side of the mobile rack 11 of the present invention, as shown in FIG. 10. The push rod 34 is provided with a one way clutch 35 and is set on the left end of the drive shaft 21. As the motor 25 drives the belt wheels 19, 20, belt 18, shafts 21, 22 will rotate in a forward direction, and the push rod 34 will not function. When the motor begins a reverse rotation, the push rod 34 is descended and operates to press the main lock metal plate 36. A tension spring 37 is placed under the main lock metal plate 36 to support this plate 36 which also ensures that the plate 36 can only be engaged in an upward movement. When the push rod 34 is pressed down, the main lock metal plate 36 moves downward. A plurality of troughs 38 in a curve-shaped are provided on the lock metal plate 36. The curve-shaped troughs match with the jutting pin 39 on the right rear end of each bin 17. As the jutting pin 39 is on the bottom end of the rear blocking region 40 in the trough 38, the paper bins 17 could not be removed forward due to the fact that its rear portion is impeded. When the push rod 34 presses the main lock metal plate 36, the jutting pins 39 are forced to be in the sliding region 41 of the front-middle portion of the troughs 38. Therefore, the paper bins 17 can be removed forward, herein, the main switching lock control mechanism is in operation.

Figure 12:
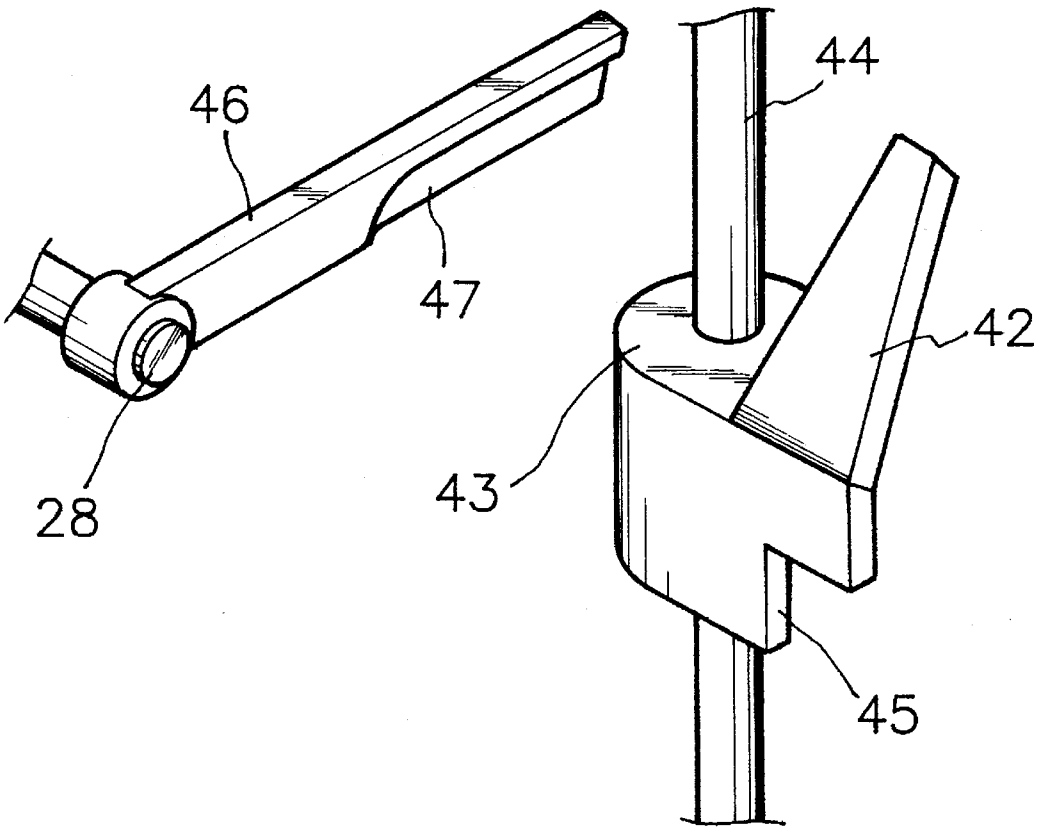
FIG. 12 is a perspective view of the wedge shape plate of the present invention.

In addition to using the main lock metal plate 36 as the main lock controlling system to lock and unlock all the paper bins, in the rear end of each bin 17 is also provided with a separate wedge-shaped plate 42, which can independently control the opening of each bin, as shown in FIG. 12. Each wedge-shaped plate 42 has a cylindrical casing 43 for connection at its bottom. A vertical pole 44 penetrates through the cylindrical casing 43 to hold the wedge-shaped plate 42 in position. The wedge-shaped plate 42 is formed with the cylindrical casing 43 using a single-body molding process with a blocking surface 45 in right angle. Additionally, a wedge-shaped pole 46 is correlated to each wedge-shaped plate 42 on the left end of the mobile rack 11. A wedge-shaped surface 47 is on the wedge-shaped pole 46 whose rear end is fixed on the left end of the shaft 28. Via the rotation of the shaft 28, the wedge-shaped pole 46 is controlled to lie down. As a result, the wedge-shaped surface 47 presses the correlated wedge plate 42, allowing the rotation of cylindrical casing 43, and drives the rectangle blocking surface 45 to operate simultaneously. The rectangle blocking surface generally locates in the sliding region 41 of the trough 38 because of a spring (not shown in the figure), blocks the jutting pin 39 to slide forward and thus the paper bins 17 cannot be removed forward. When the controlling wedge shape poles 46 press the wedge plate 42 and drive the blocking surface 45 to operate, the blocking surface 45 shifts away from the sliding region 41 of the trough 38. The jutting pins 39 cannot be stemmed by the blocking surface 45 and the paper bin 17 can be retreated forward. Therefore, the structure of the independent lock control system for each paper bin is constructed. The main lock metal plate 36 and the wedge plate 42 form the two lock control systems. As the paper guiding plates 30 lie down and all the wedge plates 42 are pressed down, the paper bins 17 still cannot be opened. The paper bin 17 can only be opened by the pre-set codes under the computer-controlled main lock metal plate 36 and the wedge plate 42. When the plates were pressed down simultaneously, the paper bins then can be removed forward.

Figure 11:
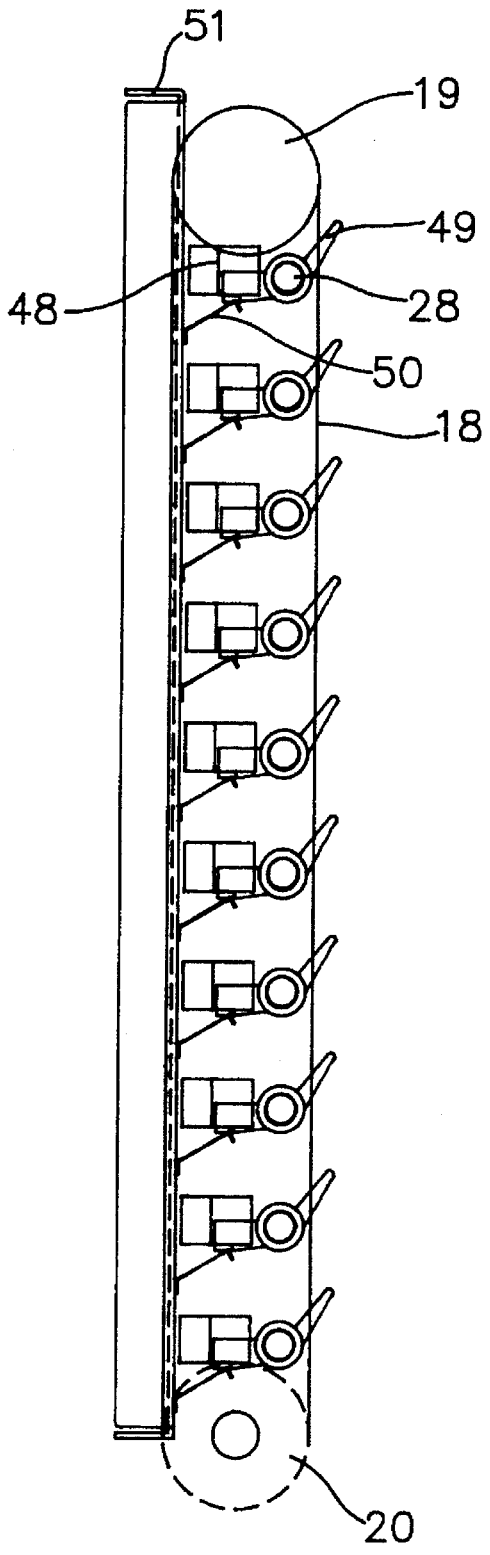
FIG. 11 is a side view of the part of the paper sensor of the present invention.

Additionally a sensor 48 is installed on a supporting rack 51 which is located in a relevant position behind each shaft 28 of the paper guiding plate 30, as shown in FIG. 11. A correlated sway beam 49 is penetrated by and fixed on the shaft 28. The rear end of each sway beam 49 is inside the sensor 48. A spring plate 50 is under the sway beam and supports the rear end of the beam. The sensor 48 is used to count the number of papers and detect the occurrence of a paper jam.

On the top of all the closed type paper bins 17, an open type paper public bin 52 is installed. An idle gear 53 is set up and matches with the gear 23 on the left end of the drive shaft 21. The idle gear 53 further matches with the gear 54 of a paper exit roller 55. The right end of the gear 54 is connected to the same pole with the paper exit roller 55. Under the paper exit roller 55, a correlated paper wedging and transferring roller 56 is closely located. The papers not intercepted by the paper guiding plates 30 are transferred via the belt 18 upward to the paper exit roller 55 to the paper public bin 52. Because of the design of the closed type paper bins with the structure of the lock control systems, the printed documents are absolutely confidential and can not be easily pried into by any unrelated person.

We claim:

1. An electronic apparatus for receiving and distributing confidential papers comprising:

a motor, which is connected to a plurality of gears, a plurality of transmission belts, and a plurality of correlated rollers, for transferring printed papers from a printer output to one of a plurality of closed-type paper bins via an arched paper guiding plate;

means for providing a computer signal to control the selection of said closed-type paper bin for sending said printed papers;

a main lock control system provided for locking and unlocking said closed-type paper bins in their entirety;

a plurality of independent lock control modules, each of said independent lock control modules being provided for everyone of said closable paper bins;

lock opening means provided with said independent lock control modules which allows a user to lock and unlock one of said closed-type paper bins by entering a set of computer-set codes.

2. An electronic apparatus for receiving and distributing confidential papers of claim 1 wherein said paper bins comprise a plurality of overlapped bins.

3. An electronic apparatus for receiving and distributing confidential papers of claim 1 which further comprises a sensor installed on a path to be travelled by said papers so as to count the number of papers and detect any paper jam.

4. An electronic apparatus for receiving and distributing confidential papers of claim 1 which further comprises an open-type paper bin disposed on top of said closed-type paper bins for public access.

5. An electronic apparatus for receiving and distributing confidential papers of claim 1 wherein said main lock control system comprises:

a main lock metal plate with a tension spring to support said main metal lock plate from underneath;

a jutting pin on the rear end of said closed-type bins, a trough provided on said main lock metal plate for impeding said jutting pin and preventing said paper bins from moving forward.

6. An electronic apparatus for receiving and distributing confidential papers of claim 5 wherein each of said independent lock control modules comprises a wedge plate, which contains a blocking surface on one end thereof, said blocking surface being provided to stop said jutting pin of said paper bin so as to separate said blocking plate form said jutting pin and move said paper bins forward.

* * * * *